US006229551B1

(12) United States Patent
Huang

(10) Patent No.: US 6,229,551 B1
(45) Date of Patent: May 8, 2001

(54) STRUCTURAL GRAPH DISPLAY SYSTEM

(75) Inventor: Yi-hui Huang, Taipei Hsien (TW)

(73) Assignee: Arphic Technology Co., Ltd., Taipei ( * ) Notice: Subject to any disclaimer, the term of this patent is extended or adjusted under 35 U.S.C. 154(b) by 0 days.

(21) Appl. No.: 09/133,676

(22) Filed: Aug. 13, 1998

(51) Int. Cl.[7] ..... G09G 5/22

(52) U.S. Cl. ..... 345/440; 471/467; 471/141; 471/192; 471/194; 471/133

(58) Field of Search ..... 345/116, 467, 345/471, 141, 16, 17, 23, 24, 133, 145, 146, 140, 192, 194, 440, 2; 707/535, 541; G09G 5/22

(56) References Cited

U.S. PATENT DOCUMENTS

| | | | | |
|---|---|---|---|---|
| 4,852,019 | * | 7/1989 | Vinberg | 345/440 |
| 4,990,903 | * | 2/1991 | Cheng | 345/471 |
| 5,212,769 | * | 5/1993 | Pong | 345/467 |
| 5,771,048 | * | 6/1998 | Nankou | 345/471 |
| 5,923,321 | * | 7/1999 | Huang | 345/141 |

* cited by examiner

*Primary Examiner*—Matthew Luu
*Assistant Examiner*—Wesner Sajous
(74) *Attorney, Agent, or Firm*—Winston Hsu

(57) ABSTRACT

The present invention provides a structural graph display system which makes use of central region distribution of graphic parameters to make index tables to reduce the bit number required for storing each graphic parameter. Each structural graph is formed by at least one sub-graph, and each sub-graph comprises a plurality of parameters which includes a target parameter array. The system further comprises an index table which comprises a set of reference parameter arrays. Each reference parameter array has a corresponding reference index number. The index table further has at least one special index number. Within the graphic description file, each sub-graph of a structural graph has a replacement ID for replacing the target parameter array; if the offset between the target parameter array and any reference parameter array is within a predetermining offset range, the replacement ID is formed by the reference index number of the reference parameter array and a offset array. If not, the replacement ID is formed by the special index number and the target parameter array.

26 Claims, 5 Drawing Sheets

96

| | | |
|---|---|---|
| ID 7 | (X1,Y1)(X2,Y2)(X3,Y3)····· | W1W2 |
| ID 9 | (X1,Y1)(X2,Y2)(X3,Y3)····· | W1W2 |
| ID 53 | (X1,Y1)(X2,Y2)(X3,Y3)····· | W1W2 |
| ID 103 | (X1,Y1)(X2,Y2)(X3,Y3)····· | W1W2 |

98

| | | |
|---|---|---|
| ID 7 | '9(dx1,dy1),'7(dx2,dy2)(dx3,dy3) | W1W2 |
| ID 9 | '5(dx1,dy1),'4(dx2,dy2)(dx3,dy3) | W1W2 |
| ID 53 | 'F(dx1,dy1),'6(dx2,dy2)(dx3,dy3) | W1W2 |
| ID 103 | '7(dx1,dy1),'F(dx2,dy2)(dx3,dy3) | W1W2 |

STRUCTURAL GRAPH DISPLAY SYSTEM

BACKGROUND OF THE INVENTION

1. Field of the Invention

The present invention relates to a structural graph display system, and more particularly, to a structural graph display system which utilizes index tables for reducing memory for storing graphic data.

2. Description of Prior Art

At present, high quality Chinese characters are commonly formed by using a stroke-combined character technique wherein each Chinese character is considered a structural graph formed by a plurality of strokes where each stroke is a sub-graph formed by its individual contour. Although the varieties of strokes used in forming Chinese characters are few, the length, thickness and orientation of like strokes differ based on their placement within the word. Despite these differences, the contour feature of any one form of stroke, such as ㄱ-ㄴ, remains relatively constant. Thus, if the length, angle, key point(s) and stroke width(s) of one stroke can be determined separately, the contour of the stroke can be easily drawn by executing a generation program.

Basically, each stroke has a fixed number of key points and stroke widths, and each stroke can be drawn by a stroke generation program. The stroke generation program is written by Graphic description language, and can draw the contour of one stroke in a rectangular area according to each given key point and stroke width. Each character is a combination of individual strokes sequentially drawn in a rectangular area by executing the stroke generation program of each stroke.

Please refer to FIG. 1. FIG. 1 shows a data structure of a prior art stroke table 10. Each stroke on the stroke table 10 has a stroke ID 14 and a stroke generation program 12. The computer system draws the contour of the stroke in a rectangular area using the stroke generation program corresponding to the stroke ID and using the key point(s) and stroke width(s) parameters of the stroke.

Please refer to FIG. 2 and FIG. 3. FIG. 2 shows the contour of a stroke 20 and the position of each key point and stroke width. FIG. 3 shows a data structure 24 of the stroke 20. The stroke 20 has three key points (x1, y1), (x2, y2), (x3, y3) and two stroke widths w1, w2. The data structure 24 comprises a stroke ID (ID7) of the stroke 20, the key points and stroke widths.

Please refer to FIG. 4. FIG. 4 shows a data structure of a prior art character description file 28. The character description file 28 is used for storing the strokes contained within the character, and the stroke ID, key point, stroke width of each stroke. The character description file 28 contains an index table 30 and stroke description table 32 of each character. The index table 30 contains a word ID (WID) for each character and the address of the corresponding stroke description table 32. The stroke description table 32 is a combination of the data structures of all strokes of a character. Like the data structure 24 shown in FIG. 3, the stroke description table 32 comprises the stroke data of all strokes: stroke IDs, key points, and stroke widths. The stroke data are arranged in a predetermined order, such as the writing sequence. When drawing a character, the computer system can locate the stroke description table 32 of the character by using the index table 30 of the stroke description table 28 as long as the word ID of the character is known. Afterward, the computer system will draw all strokes of the character one by one in a rectangular area in conjunction with the stroke table 10.

The above mentioned prior art character description file 28 has a major shortcoming in that it requires a large amount of memory space for storage. In the data structure 24 shown in FIG. 3, each stroke ID takes eight bits as does each x, y coordinate or stroke width. In total, it requires 72 bits for a very simple stroke such as stroke 20. Currently, there are approximately 14,000 Chinese characters in commercially available Chinese character generators with a high number of strokes per character. Therefore, the character description file of one Chinese character generator requires about 1.5 MB (mega-byte) of memory space. A personal computer would be able to accommodate this memory requirement, but small text-display systems, such as pagers, hand-held calculators, pocket-electronic notebooks, etc., would be unable to do so. Most of these small text-display systems use ROM (read only memory) for storing the character data, and their memory space is very limited. Several Chinese character generators often have to be stored in the limited memory space of these small systems for increased effectiveness of character display or variation in the display making storage very difficult or impossible.

Animated cartoons, like Chinese characters, can be considered a form of structural graph. The figure description file and animation table can be used for describing and drawing the different parts, such as the hand, foot or tail of each figure's graph in an animated cartoon. The data structures of the figure description file and animation table are similar to the data structure of the above mentioned character description file. If the memory space requirement of the data structure of the commonly seen structural graph such as the character description file and figure description file can be greatly reduced, the problem of limited memory space of the small systems can be resolved.

SUMMARY OF THE INVENTION

It is therefore a primary objective of the present invention to provide a structural graph display system which utilizes index tables to reduce memory space needed for storing graphic information.

Briefly, in a preferred embodiment, the present invention provides a structural graph display system which uses index tables to reduce the bit number required for storing each graphic parameter. Each structural graph is formed by at least one sub-graph, and each sub-graph comprises a plurality of parameters which includes a target parameter array. The system further comprises an index table which comprises a set of reference parameter arrays. Each reference parameter array has a corresponding reference index number. The index table further has at least one special index number. Within the graphic description file, each sub-graph of a structural graph has a replacement ID for replacing the target parameter array. If the offset between the target parameter array and any reference parameter array is within a predetermined offset range, the replacement ID is formed by the reference index number o f the reference parameter array and an offset array. If not, the replacement ID is formed by the special index number and the target parameter array.

It is an advantage of the pre se nt invention that the structural graph display system makes use of index tables to reduce the size of the graphic description file so that the memory space needed for storing graphic information can be saved.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 5:
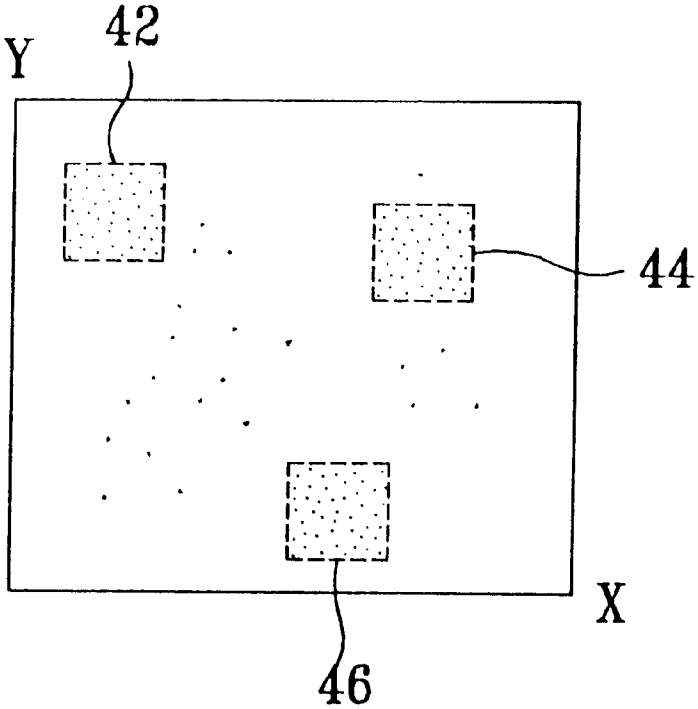
FIG. 5 shows a distribution on a coordinate plane of a designated graphic parameter.

The present invention reduces the bit number required by each graphic parameter by central region distribution of graphic parameters to make index tables as seen in FIG. 5. FIG. 5 shows a distribution on a coordinate plane of a designated graphic parameter, such as a distribution of all first key points of a designated kind of stroke within a character description file. Each graphic parameter can be represented as coordinate (x, y) where x and y each require one byte of memory space. For example, if there are 1000 graphic parameters in a region, the graphic parameters require 2000 bytes of memory space.

According to the distribution, the graphic parameters are distributed more centrally in region 42,44,46 than in other regions. The central points of the three regions 42, 44, 46, such as (x1, y1), (x2, y2), (x3, y3), can be selected as reference graphic parameters to make the following graphic parameter index table:

| index number | reference graphic parameter |
|---|---|
| 0 | (x1, y1) |
| 1 | (x2, y2) |
| 2 | (x3, y3) |
| 3 | |

wherein 0, 1, 2 are commonly used index numbers, and 3 is a special index number. All graphic parameters (x, y) shown in FIG. 5 can be converted to one of the following two replacement ID forms by utilizing the graphic parameter index table:

form1 INDX, (dx, dy)

form2 3, (x, y)

wherein INDx is a commonly used index number requiring two bits and can be 0, 1 or 2. Both dx and dy require four bits and the values of dx and dy are in the range of −8 to 7. The method of converting graphic parameters (x, y) is: if the offsets dx and dy between one graphic parameter (x, y) and any reference graphic parameter (x1, y1), (x2, y2) or (x3, y3) are both within the range of −8 to 7, the graphic parameter (x, y) will be converted to replacement ID form1. If the offsets dx and dy are not both within the range, a special index number 3 is added before the coordinate (x, y) converting the graphic parameter (x, y) into replacement IDform2. Form1 requires a total of 10 bits, and form2 requires a total of 18 bits. Each replacement ID formed by the conversion of graphic parameters is always preceded by a commonly used index number or a special index number. The replacement ID can be converted back to a graphic parameter by using the form1, form2 and graphic parameter index table.

The conversion of graphic parameters into replacement IDs effectively reduces the required memory space by a graphic parameter in a character description file. As shown in FIG. 5, the graphic parameters are distributed more centrally in region 42, 44, 46 than in other regions. Thus, the reference graphic parameters (x1, y1), (x2, y2) and (x3, y3) determined by the central points of these three region can be used for converting most graphic parameters in the three regions according to form1. If 90% of the graphic parameters are converted to replacement ID form1 and 10% are converted to form2, the total memory space required by the replacement IDs and graphic parameter index table is 1360 bytes which is 68% of the memory space required by the unconverted graphic parameters.

Figure 6:
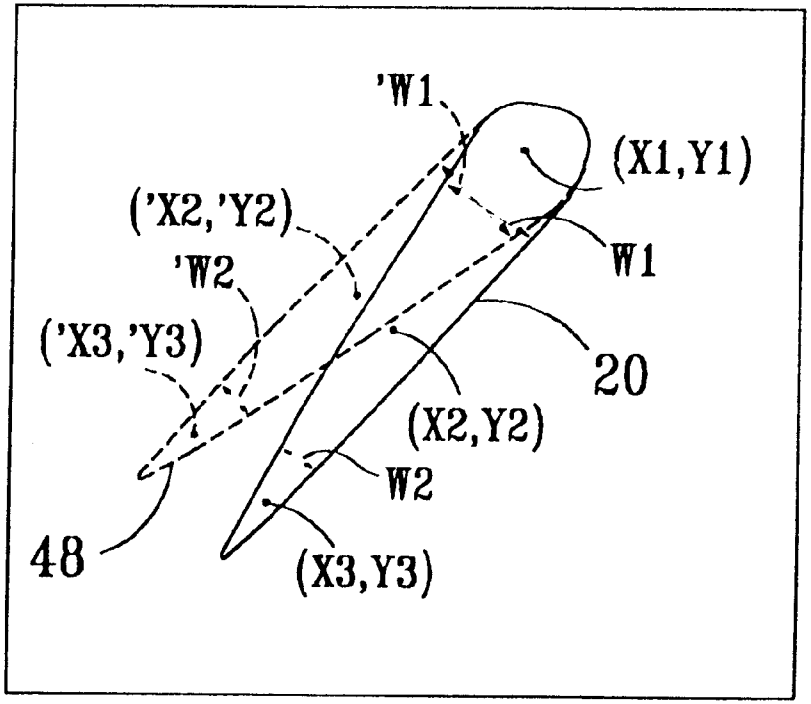
FIG. 6 shows two like strokes overlapping one another over the first key points.

Please refer to FIG. 6. FIG. 6 shows another method for utilizing an index table to reduce memory space required by graphic parameters of a stroke. FIG. 6 shows two strokes of the same type, 20 and 48, overlapping on the first key points. Because they are the same type of stroke, they have the same stroke ID and data structure. As shown in FIG. 6, when one stroke overlaps another on the first key point, the offsets between the other key point coordinates of the two strokes are relatively small. Thus, the key points of several more commonly used strokes used as reference strokes can be used for making the following stroke key point index table:

| index number | key points of reference stroke |
|---|---|
| 0 | (x1, y1) (x2, y2) (x3, y3) |
| 1 | (x1, y1) (x2, y2) (x3, y3) |
| ... | ... ... ... |
| 14 | (x1, y1) (x2, y2) (x3, y3) |
| 15 | |

wherein 0 to 14 are commonly used index numbers, and 15 is a special index number. In a character description file, except for the first key point, all other key points of each stroke can be converted into one of the following two replacement ID forms by utilizing the stroke key point index table of that form of stroke:

form3 INDX, (dx2, dy2), (dx3, dy3)

form4 15, (x2, y2), (x3, y3)

wherein INDx is a commonly used index number requiring four bits and can be 0 to 14. Both dx and dy require four bits and the values of dx and dy are in the range of −8 to 7. The method of converting key points of each stroke is: after shifting the first key point of the stroke to the first key point of the first reference stroke, if the offsets dx and dy between the other key point coordinates of the stroke and the corresponding key point coordinates of the first reference stroke are all within the range of −8 to 7, the stroke will be converted into replacement ID form3. Otherwise, the other reference strokes will attempted one by one for converting the stroke into form3. If no reference stroke is within range, a special index number 15 will be added before the key point coordinate to convert the stroke into replacement ID form4.

Except for the first key point, all other key points of each stroke are always preceded by a commonly used index number or special index number after undergoing the conversion process. Each replacement ID can be restored by using the form3, form4 and stroke key point index table of each stroke.

As in the example shown in FIG. 5, this method of converting key points can be used for reducing the memory space required by all key points other than the first key point of each stroke in a character description file. The more strokes that can be converted into replacement ID form3 using the stroke key point index table of each stroke, the less memory space is required by a character description file. For each kind of stroke, graph statistics determine how to select a set of reference strokes to make the stroke key point index table of the stroke. A very simple and practical method is by converting a second stroke by defining a first stroke as a reference stroke and, if successful, add 1 to the base number of the first stroke. If not, define the second stroke as another reference stroke. Using this method, the defined reference stroke is compared in succession with all of the different kinds of strokes in a character description file. After comparing each form of stroke with each reference stroke, the fifteen reference strokes with the greatest base numbers are used for creating the stroke key point index table for that kind of stroke.

Figure 3:
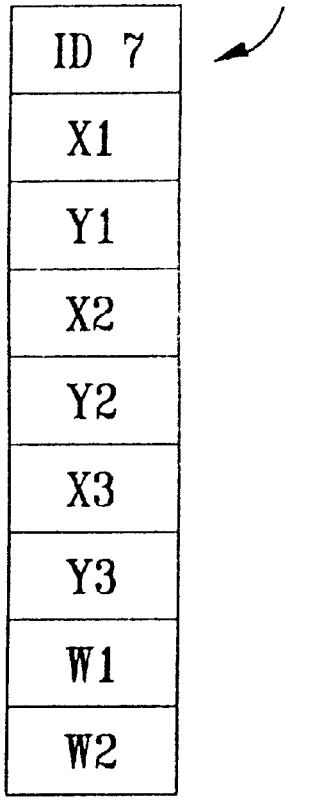
FIG. 3 shows a data structure of the stroke shown in FIG. 2.
Figure 2:
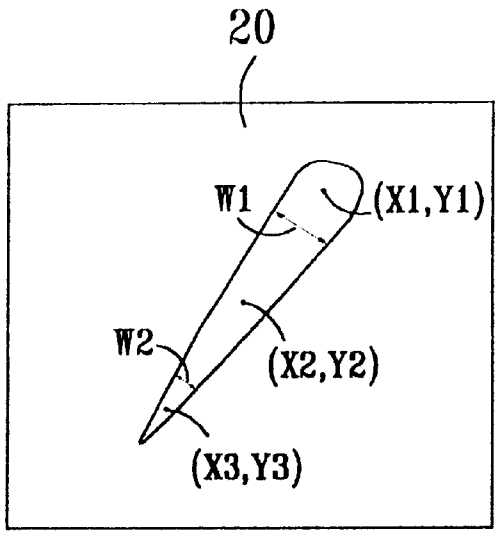
FIG. 2 shows the contour of a stroke and each key point and stroke width.

According to the present invention, memory space required by the character description file 28 shown in FIG. 3 is reduced using the two methods utilizing index tables to reduce the memory space required for storing structure data of each stroke. The method will be described in the following figures.

Figure 7:
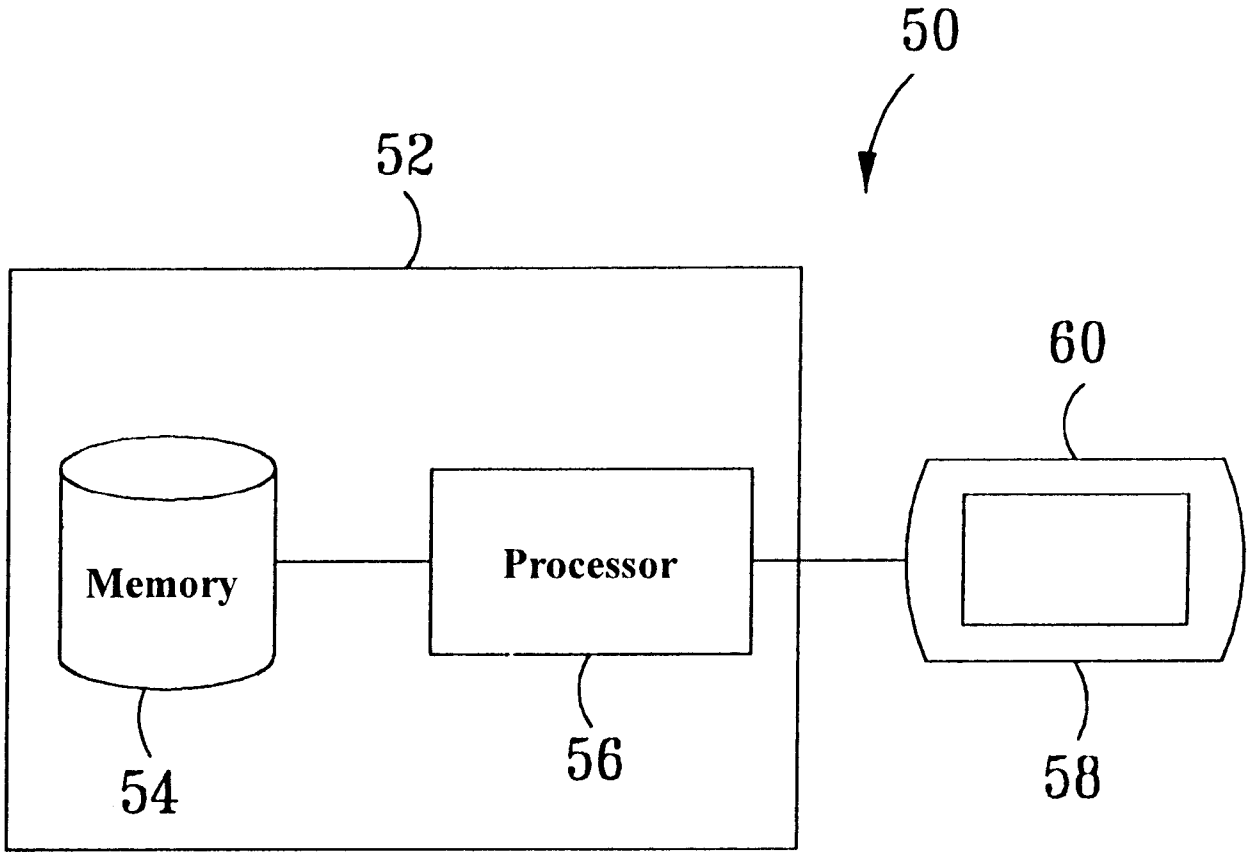
FIG. 7 is the hardware system block diagram of a structural graph display system according to the present invention.

Please refer to FIG. 7. FIG. 7 is the hardware system block diagram of a structural graph display system 50 according to the present invention. System 50 comprises a computer 52 and a monitor 60. Computer 52 comprises a memory 54 for storing programs and data, and a processor 56 for executing the programs stored in memory 54. The monitor 60 comprises a screen 58 for displaying structural graphs, such as Chinese characters, generated by the computer 52.

Figure 1:
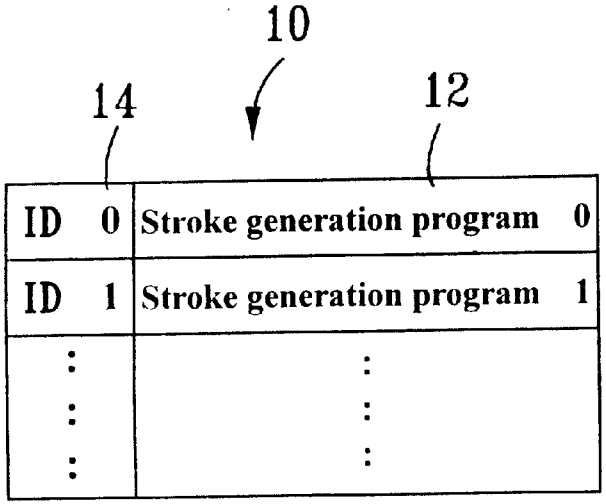
FIG. 1 shows a data structure of a prior art stroke table.
Figure 4:
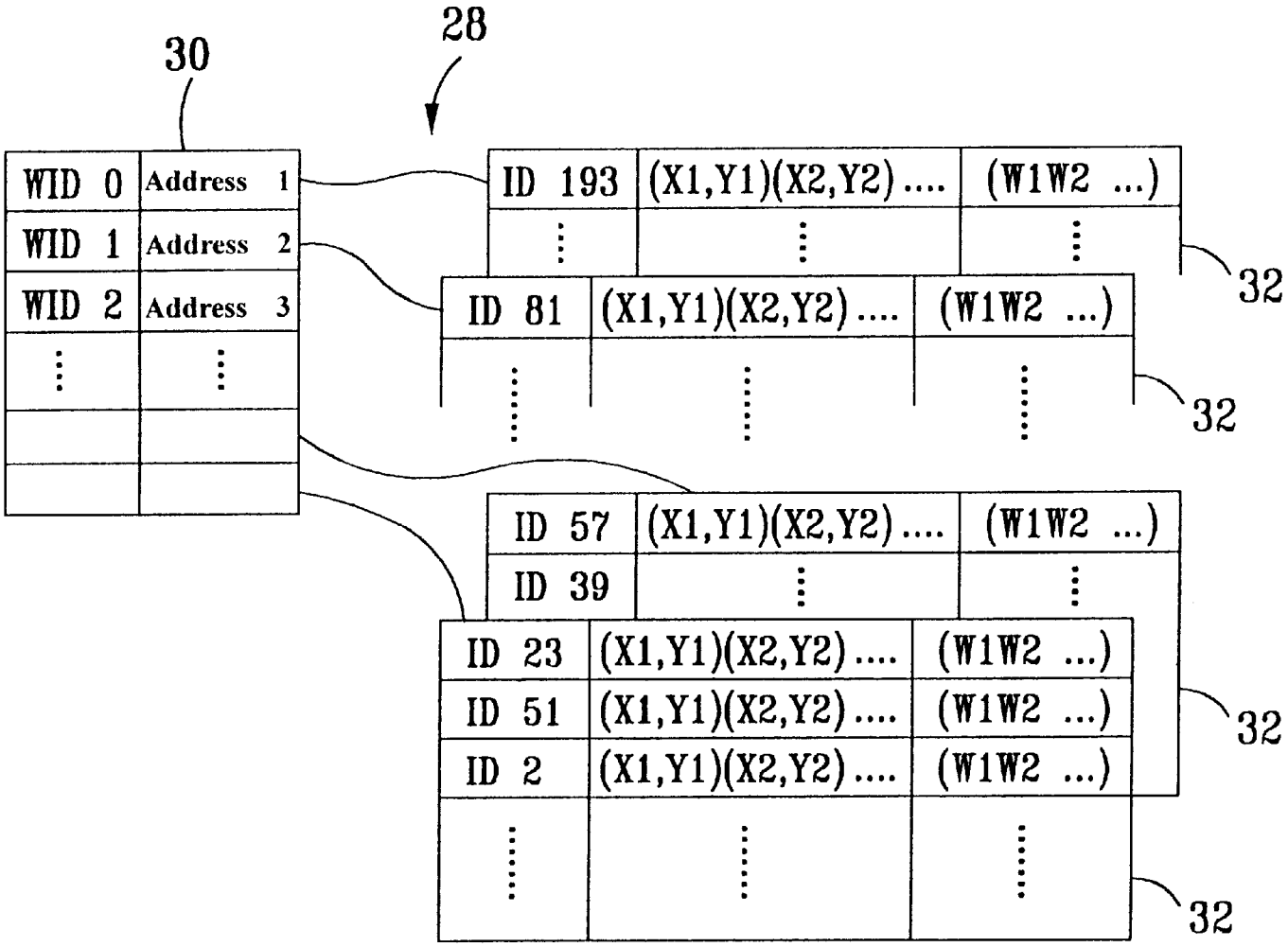
FIG. 4 shows a data structure of a prior art character description file.
Figures 8, 9:
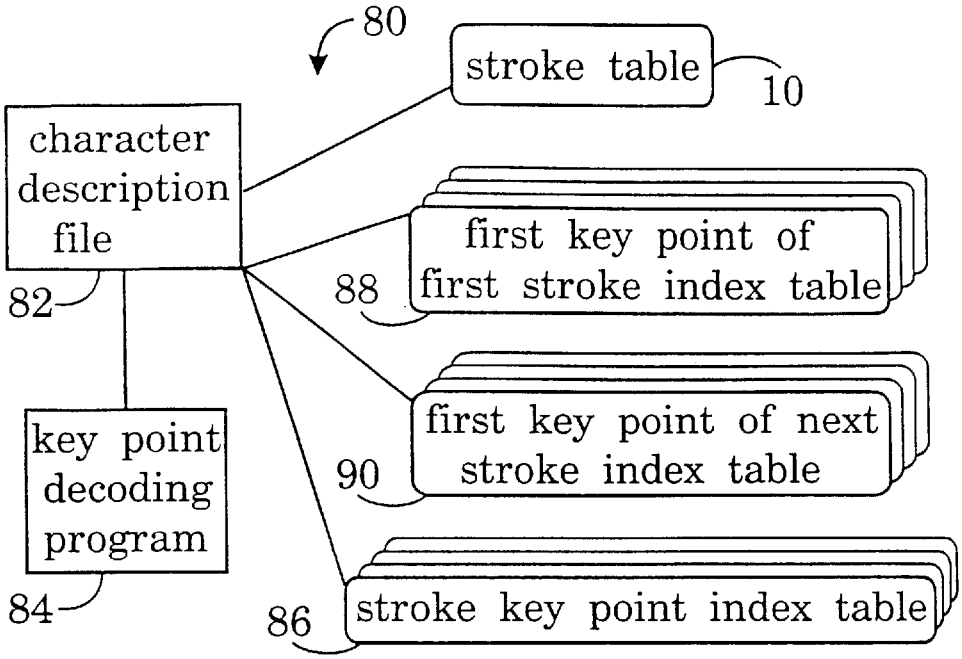
FIG. 8 is the software system block diagram of a structural graph display system according to the present invention.
FIG. 9 shows data structures of strokes of a character and data structures of their replacement IDs after converting.

Please refer to FIG. 8. FIG. 8 is the software system 80 block diagram of a structural graph display system 50 according to the present invention. The system 80 stored in the memory 54 of computer 52 comprises a character description file 82, a stroke table 10, a key point decoding program 84, a set of stroke key point index tables 86, a first key point of first stroke index table 88 and a set of first key point of next stroke index tables 90. The data structure of the stroke table 10 is shown in FIG. 1.

Each key point in the prior art character description file 28 requires 16 bits. By using the stroke key point index tables 86, the first key point of first stroke index table 88, and the first key point of next stroke index tables 90, the system 80 converts most of the key points in the character description file 28 into 8-bit offsets and a 4-bit index number to reduce the memory space required for storing the character description file 82. When drawing Chinese characters, the key point decoding program 84 is used for converting the offset of each stroke in the character description file 82 into a key point coordinate to make each stroke generation program 12 stored in stroke table 10 draw the character according to the key point coordinates.

In the prior art character description file 28, all strokes of each character are arranged according to a designated drawing sequence, such as the writing sequence. The stroke in each character which appears first is defined as a first stroke, and the stroke immediately following each stroke is defined as a next stroke. In the character description file 28, after analyzing the positions of first key points of first strokes of all characters, it can be seen that the positions of first strokes of most characters are distributed centrally at the left-up or central-up positions of a rectangular area. Because of the central distribution, the index table shown in FIG. 5 can be used for converting the first key point of the first stroke of each character in the character description file 28 into form1 or form2. The first key point of the first stroke index table 88 is formed by the first key points of fifteen different first strokes. These fifteen first key points represent fifteen regions where first key points are distributed centrally. First key points of first strokes within these regions can be converted into replacement ID form1 by using the fifteen first key points, and first key points of first strokes outside these regions can be converted to replacement ID form2.

In character description file 28, the distances between first key points of all strokes and first key points of their next strokes, in drawing sequence, are also distributed centrally which means that the drawing position of a designated stroke is closely related to the drawing position of its next stroke. The distances between the positions of the first key points of all kinds of strokes are analyzed with respect to the positions of the first key points of each of their next strokes. Data for the first key point for the next stroke index table 90 for that kind of stroke is determined by using the distances within the fifteen centrally-distributed regions using the index table in FIG. 5. Because each kind of stroke has a first key point of next stroke index table 90 in all drawing sequences, first key points of all next strokes can be converted into form1 or form2 by using the first key point of next stroke index table 90 of its former stroke to reduce the memory space required for storing the first key point of each next stroke.

In summary, using the first key point of the first stroke index table 88 and the first key point of the next stroke index table 90 for all varieties of strokes, first key points of all strokes stored in the character description file 28 can be converted into replacement IDs. Furthermore, all key points following the first key point of all strokes can be converted through use of the index table shown in FIG. 6 which can use fifteen reference strokes to make the stroke key point index table 86 for each variety of stroke. Thus, by using the stroke key point index table 86 of the specified stroke, all key points following the first key point of each stroke in character description file 28 can be converted to form3 or form4 to reduce the memory space required for storing the first key point of each next stroke.

The character description file 82 shown in FIG. 8 differs from the prior art character description file 28 shown in FIG. 3 in that in the character description file 82, the first key point of the first stroke of each character is converted into a replacement ID by using the first key point of the first stroke index table 88, and first key points of all subsequent strokes of each character are converted into replacement IDs by using the first key point of the next stroke index tables 90, and all key points following each first key point of each stroke are converted into replacement IDs by using the stroke key point index table 86 of each stroke. When drawing a Chinese character, the key point decoding program 84 is used for restoring the replacement ID of the first key point of the first stroke by using the first key point of the first stroke index table 88, restoring the replacement IDs of first key points of all next strokes by using the first key point of next stroke index table 90, and restoring the replacement IDs of all key points following the first key point of each stroke by using the stroke key point index table 86 of each stroke to make each stroke generation program 12 in the stroke table 10 of the software system 80 draw a character according to the restored key points.

Please refer to FIG. 9. FIG. 9 shows data structures 96 of four strokes of a Chinese character and data structures 98 of their replacement IDs after conversion. The first key point (x1, y1) of the first stroke (ID7) is converted into a replacement ID '9 (dx1, dy1) by using the first key point of the first stroke index table 88. The first key point (x1, y1) of the second stroke (ID9) is converted into a replacement ID '5 (dx1, dy1) by using the first key point of the next stroke index table 90 of the first stroke (ID7).

This procedure is repeated for each first key point of each stroke. The first key point (x1, y1) of the third stroke (ID53) is converted to replacement ID 'F(x1, y1) by using the first key point of the next stroke index table 90 of the second stroke (ID9), and the first key point (x1, y1) of fourth stroke (ID103) is converted to a replacement ID '7 (dx1, dy1) by using the first key point of the next stroke index table 90 of the third stroke (ID53). All key points following the first key point of each stroke are converted into a replacement ID by using the stroke key point index table 86 of each stroke. For example, all key points (x2, y2), (x3, y3) following first key point of first stroke (ID7) are converted into replacement ID '7 (dx2, dy2) (dx3, dy3) by using stroke key point index table 86 of first stroke (ID7). Before drawing the Chinese character shown in FIG. 9, the key point decoding program 84 will convert the replacement IDs in data structures 98 into the key points in data structures 96.

In the data structures 96 in FIG. 9, if each stroke has three key points and each key point requires 16 bits, the four strokes would require 192 bits in total. In the data structures 98, the replacement IDs require a total memory space of 152 bits which uses only 79% of 192 bits. When drawing the Chinese character in FIG. 9, the software system 80 in FIG. 8 uses the key point decoding program 84 to convert the replacement IDs into key points prior to drawing the character. The present invention utilizes index tables to save memory space, however, during the conversion process the processor 56 requires increased processing time. In other words, the more memory space saved, the longer the calculating time. Users of small text-display systems will not notice a degradation in speed as the rapid calculating speed of processors makes such differences negligible. However, the memory space of small text-display systems is very limited making the savings in memory space and higher storage capability for character description files a very important feature for users of such systems.

When using the software system 80, it is not necessary to convert the key points of all strokes into replacement IDs. Other methods for reducing the memory space needed may be used. For example, users may convert only first key points of all first strokes into replacement IDs by using first key point of first stroke index table 88, or convert only the first key points of all next strokes into replacement IDs by using the first key point of the next stroke index table 90, or only convert all key points following first key point of each stroke into replacement IDs by using stroke key point index table 86. These methods may be changed as needed.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A structural graph display system comprising a memory for storing programs and data, a processor for executing the programs stored in the memory, and a predetermined area for displaying a structural graph; each structural graph being formed by at least one sub-graph, each sub-graph comprising a plurality of parameters and a correspondent sub-graph generation program stored in the memory for drawing the sub-graph in the predetermined area according to the parameters of the sub-graph, each structural graph being formed by sequentially drawing all its sub-graphs in the predetermined area; the parameters of all the sub-graphs of each structural graph being kept in a graphic description file stored in the memory, characterized in that:

the parameters of each sub-graph comprises a target parameter array having a predetermined number of at least one parameter arranged in a specific order, the system further comprises an index table having a set of reference parameter arrays, each of the reference parameter array has a corresponding reference index number, the index table further comprises at least one special index number;

within the graphic description file, each sub-graph of a structural graph comprises a replacement ID (identification) for replacing its target parameter array: if the offset between the target parameter array and one of the reference parameter arrays of the index table generated by a first calculating process is within a predetermined offset range, the replacement ID is formed by the reference index number of the reference parameter array and an offset array, the offset array and the reference parameter array can be used to generate the replaced target parameter array through a second calculating process, the total bit numbers of the reference index number and the offset array are less than the bit number of the replaced target parameter array; if the offset between the target parameter array and any of the reference parameter arrays of the index table generated by the first calculating process is not within the predetermined offset range, the replacement ID is formed by the special index number and the target parameter array.

2. The structural graph display system of claim 1 wherein the predetermined area is within a computer screen which is used for displaying the structural graph.

3. The structural graph display system of claim 1 wherein the structural graph is a character formed by at least one stroke and each sub-graph of the structural graph is a stroke of the character.

4. The structural graph display system of claim 3 wherein each stroke of a character comprises a stroke ID, at least one key point coordinate and at least one stroke width which are defined as the parameters of the stroke.

5. The structural graph display system of claim 3 wherein the target parameter array is formed by a plurality of coordinate parameters of a stroke.

6. The structural graph display system of claim 1 wherein the first calculating process is to subtract the reference parameter array from the target parameter array to get the offset array.

7. The structural graph display system of claim 6 wherein the second calculating process is to add the offset array and the reference parameter array to obtain the target parameter array.

8. A structural graph display system comprising a memory for storing programs and data, a processor for executing the programs stored in the memory, and a predetermined area for displaying a structural graph; each structural graph being formed by at least one sub-graph, each sub-graph of a structural graph comprising a plurality of parameters and a correspondent sub-graph generation program stored in the memory for drawing the sub-graph in the predetermined area according to the parameters of the sub-graph, each structural graph being formed by sequentially drawing each of its sub-graphs in the predetermined area; the parameters of all the sub-graphs of each structural graph being kept in a graphic description file stored in the memory, characterized in:

the parameters of each sub-graph including a target parameter array comprising a predetermined number of at least one parameter arranged in a specific order, each sub-graph comprising a sub-graph index table having a set of reference parameter arrays, each reference parameter array having a corresponding reference index number, the index table further comprising at least one special index number;

within the graphic description file, each sub-graph of a structural graph having a replacement ID for replacing its target parameter array; if the offset between the target parameter array of the sub-graph and one of the reference parameter arrays of its sub-graph index table generated by a first calculating process is within a predetermined offset range, its replacement ID is formed by the reference index number of the reference parameter array and an offset array, the offset array and the reference parameter array can be used to generate the replaced target parameter array through a second calculating process, the total bit number of the reference index number and the offset array are less than the bit number of the replaced target parameter array; if the offset between the target parameter array of the sub-graph and any of the reference parameter arrays of its sub-graph index table generated by the first calculating process is not within the predetermined offset range, its replacement ID is formed by the special index number and the target parameter array.

9. The structural graph display system of claim 8 wherein the structural graph is a character formed by at least one stroke and each sub-graph of the structural graph is a stroke of the character.

10. The structural graph display system of claim 9 wherein the target parameter array comprises a plurality of coordinate parameters of a stroke.

11. The structural graph display system of claim 9 wherein each stroke comprises a plurality of key point coordinates arranged in a specific order, and within the graphic description file, the target parameter array of each stroke is formed by all the key point coordinates of the stroke except the first key point coordinate of the stroke.

12. The structural graph display system of claim 11 wherein the first calculating process is to shift all key point coordinates of the target parameter array by a calculated coordinate shift, and then subtract the reference parameter array from the target parameter array to get the offset array.

13. The structural graph display system of claim 12 wherein the second calculating process is to add the offset array to the reference parameter array to obtain the target parameter array first, and then shift back all the key point coordinates of the target parameter array by the calculated coordinate shift to restore the target parameter array.

14. The structural graph display system of claim 12 wherein the calculated coordinate shift is the offset between the first key point coordinate of the target parameter array and the first coordinate of the reference parameter array.

15. The structural graph display system of claim 8 wherein each structural graph is formed by drawing all its sub-graphs one by one according to a predetermined drawing sequence in the predetermined area;

within the drawing sequence, a next sub-graph of a designated sub-graph is defined as the sub-graph immediately following the designated sub-graph in the drawing sequence, and a former sub-graph of the designated sub-graph is defined as the sub-graph immediately preceding the designated sub-graph in the drawing sequence;

within the system, each sub-graph comprises a next sub-graph index table having a set of reference parameter arrays, each of the reference parameter arrays comprising a corresponding reference index number, the table further comprises at least one special index number;

within the graphic description file, each next sub-graph within the drawing sequence of a structural graph having a replacement ID for replacing the target parameter array the next sub-graph; if the offset between the target parameter array of the next sub-graph and any of the reference parameter arrays of the next sub-graph index table of its former sub-graph generated by a first calculating process is within a predetermined offset range, the replacement ID is formed by the reference index number of the reference parameter array and an offset array, the offset array and the reference parameter array can be used to generate the replaced target parameter array in a second calculating process, the total bit number of the reference index number and offset array is less than the bit number of the replaced target parameter array; if the offset between the target parameter array of the next sub-graph and any of the reference parameter arrays of the next sub-graph index table of its former sub-graph is not within the predetermined offset range, the replacement ID is formed by the special index number of the next sub-graph index table of its former sub-graph and the target parameter array.

16. The structural graph display system of claim 15 wherein the structural graph is a character formed by at least one stroke and each sub-graph of the structural graph is a stroke of the character.

17. The structural graph display system of claim 16 wherein the target parameter array of the next stroke is formed by a plurality of coordinate parameters of the next stroke.

18. The structural graph display system of claim 17 wherein each stroke comprises a plurality of key point coordinates arranged in a specific order, and within the graphic description file, the target parameter array of each next stroke is formed by the first key point coordinate of all the key point coordinates of the next stroke.

19. The structural graph display system of claim 15 wherein a first sub-graph in the drawing sequence of each structural graph is defined as the first sub-graph of the structural graph, and the system further comprises a first sub-graph index table having a set of reference parameter arrays, each of the reference parameter arrays comprising a correspondent reference index number, the table further comprising at least one special index number;

within the graphic description file, the first sub-graph of each structural graph having a replacement ID for replacing the target parameter array of the first sub-graph: if the offset between the target parameter array and one of the reference parameter arrays of the first sub-graph index table generated by a first calculating process is within a predetermined offset range, the replacement ID is formed by the reference index number of the reference parameter array and an offset array, the offset array and the reference parameter array can be used to generate the replaced target parameter array by using a second calculating process, the total bit number of the reference index number and offset array is less than the bit number of the replaced target parameter array; if the offset between the target parameter array of the first sub-graph and any of the reference parameter arrays of the first sub-graph index table is not within the predetermined offset range, the replacement ID is formed by the special index number and the target parameter array.

20. The structural graph display system of claim 19 wherein the structural graph is a character formed by at least one stroke and each sub-graph of the structural graph is a stroke of the character.

21. The structural graph display system of claim 20 wherein the target parameter array of the first stroke is formed by a plurality of coordinate parameters of the first stroke.

22. The structural graph display system of claim 20 wherein each stroke comprises a plurality of key point coordinates arranged in a specific order, within the graphic description file, the target parameter array of each first stroke is defined as the first key point coordinate of all the key point coordinates of the first stroke.

23. A structural graph display system comprising a memory for storing programs and data, a processor for executing the programs stored in the memory, and a predetermined area for displaying a structural graph; each structural graph being formed by at least one sub-graph, each sub-graph comprising a plurality of parameters and a correspondent sub-graph generation program stored in the memory for drawing the sub-graph in the predetermined area according to the parameters of the sub-graph, each structural graph being formed by sequentially drawing all of its sub-graphs according to a predetermined drawing sequence in the predetermined area; within the drawing sequence, a next sub-graph of a designated sub-graph being defined as the sub-graph immediately following the designated sub-graph in the drawing sequence, and a former sub-graph of the designated sub-graph being defined as the sub-graph immediately preceding the designated sub-graph in the drawing sequence; the parameters of all of the sub-graphs of each structural graph being kept in a graphic description file stored in the memory; characterized in:

the parameters of each sub-graph comprising a target parameter array having a predetermined number of at least one parameter arranged in a specific order, each sub-graph comprising a next sub-graph index table having a set of reference parameter arrays, each of the reference parameter arrays having a corresponding reference index number, the index table further comprising at least one special index number;

within the graphic description file, each next sub-graph within the drawing sequence of a structural graph having a replacement ID for replacing the target parameter array: if the offset between the target parameter array of the next sub-graph and any of the reference parameter arrays of the next sub-graph index table of its former sub-graph generated by a first calculating process is within a predetermining offset range, the replacement ID is formed by the reference index number of the reference parameter array and an offset array, the offset array and the reference parameter array can be used to generate the replaced target parameter array by using a second calculating process, the total bit number of the reference index number and offset array is less than the bit number of the replaced target parameter array; if the offset between the target parameter array of the next sub-graph and any of the reference parameter arrays of the next sub-graph index table of its former sub-graph is not within the predetermining offset range, the replacement ID is formed by the special index number and the target parameter array.

24. The structural graph display system of claim 23 wherein the structural graph is a character formed by at least one stroke and each sub-graph of the structural graph is a stroke of the character.

25. The structural graph display system of claim 24 wherein the target parameter array of the next stroke is formed by a plurality of coordinate parameters of the next stroke.

26. The structural graph display system of claim 24 wherein each stroke comprises a plurality of key point coordinates arranged in a specific order, and within the graphic description file, the target parameter array of each next stroke is formed by the first key point coordinate of all the key point coordinates of the next stroke.

* * * * *